United States Patent [19]

Stark

[11] 4,441,767

[45] Apr. 10, 1984

[54] CABINET DRAWER ANTI-TIP LOCK DEVICE

[75] Inventor: Forest G. Stark, Jamestown, N.Y.

[73] Assignee: AVM Corporation, Jamestown, N.Y.

[21] Appl. No.: 370,374

[22] Filed: Apr. 21, 1982

[51] Int. Cl.[3] ..... A47B 88/00; E05C 7/06

[52] U.S. Cl. ..... 312/216; 312/107.5; 312/217; 312/221

[58] Field of Search ..... 312/215, 216, 217, 218, 312/219, 220, 221, 107.5

[56] References Cited

U.S. PATENT DOCUMENTS

| | | | |
|---|---|---|---|
| 1,063,844 | 6/1913 | Swanson | 312/221 |
| 1,193,955 | 8/1916 | Watson et al. | 312/217 |
| 1,702,385 | 2/1929 | Kaser | 312/222 |
| 2,486,460 | 11/1949 | Bonenberger | 312/215 |
| 2,930,666 | 3/1960 | Ibel | 312/218 |
| 3,199,937 | 8/1965 | Mitchell . | |
| 3,259,444 | 7/1966 | Friend | 312/221 |
| 3,297,376 | 1/1967 | Barstow . | |
| 3,371,974 | 3/1968 | Vermeersch | 312/221 |
| 3,404,929 | 10/1968 | Wright et al. . | |
| 3,602,564 | 8/1971 | Lewin . | |
| 3,767,280 | 10/1973 | McLaughlin | 312/219 |
| 3,799,639 | 3/1974 | Friend | 312/221 |
| 3,883,200 | 5/1975 | Latham . | |
| 3,888,558 | 6/1975 | Himsl . | |
| 3,900,236 | 8/1975 | Goulish et al. . | |
| 3,957,324 | 5/1976 | Klenik, Jr. et al. | 312/218 |
| 4,272,138 | 6/1981 | Stark | 312/221 |

*Primary Examiner*—Victor N. Sakran

*Attorney, Agent, or Firm*—Bean, Kauffman & Bean

[57] ABSTRACT

A file cabinet having drawers and doors and an anti-tip lock mechanism that simultaneously locks all closed doors and drawers when in a locking mode and that permits movement of a single drawer from its closed to its open position while simultaneously locking both the remaining unopened doors and all of the other drawers against movement from their closed to their open positions when in an unlocked mode.

18 Claims, 9 Drawing Figures

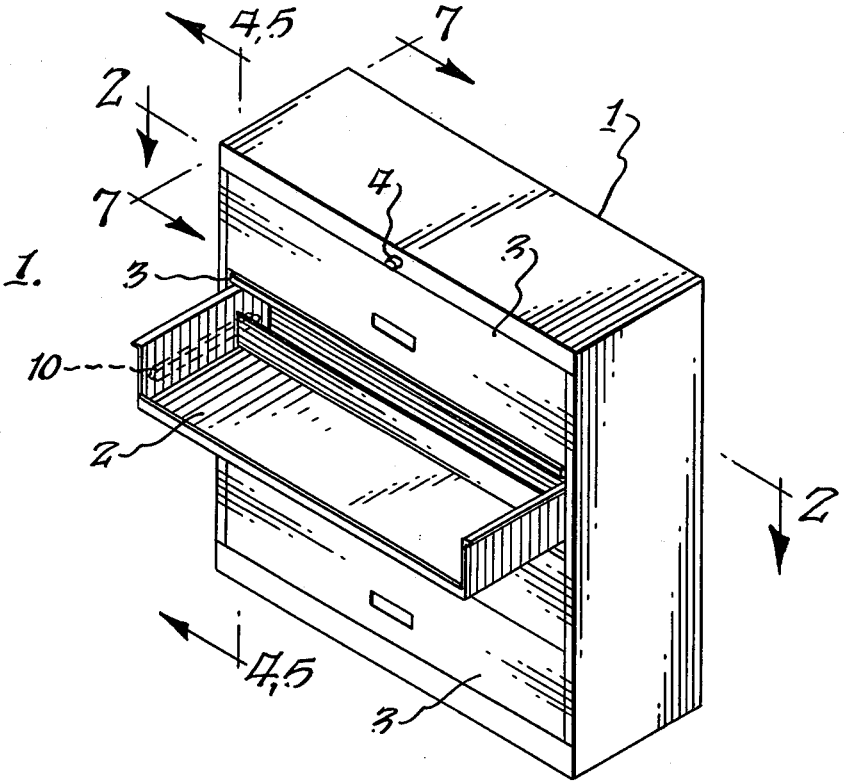
Fig. 1.
Fig. 2.
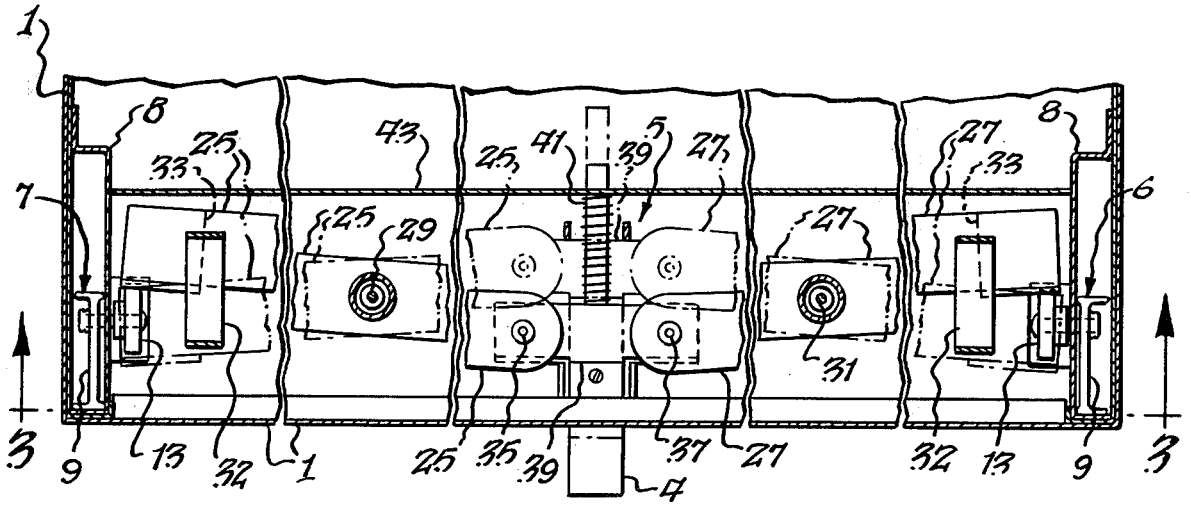
Fig. 3.
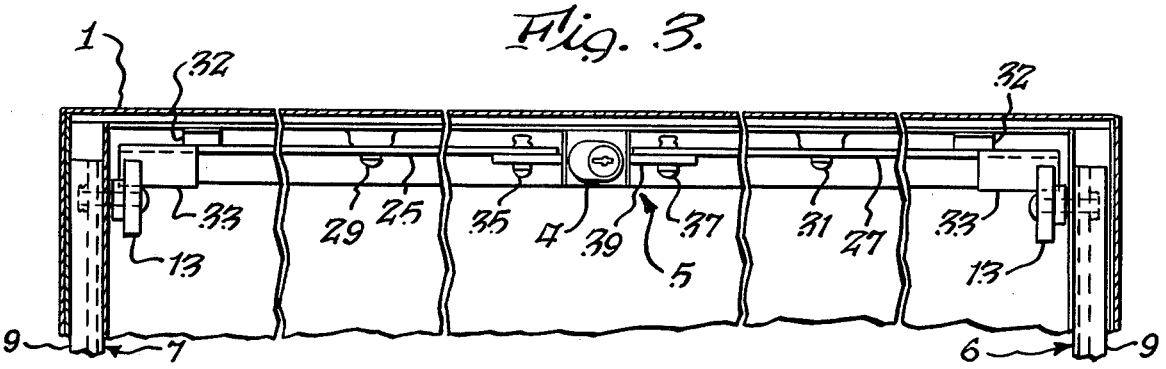

Fig. 4.
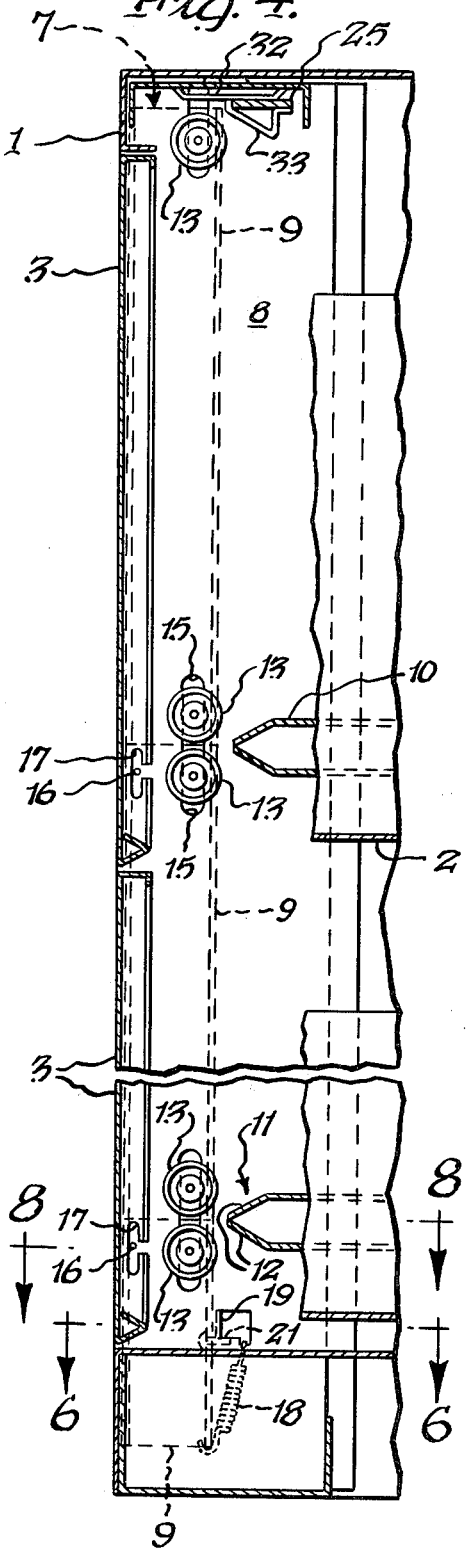
Fig. 5.
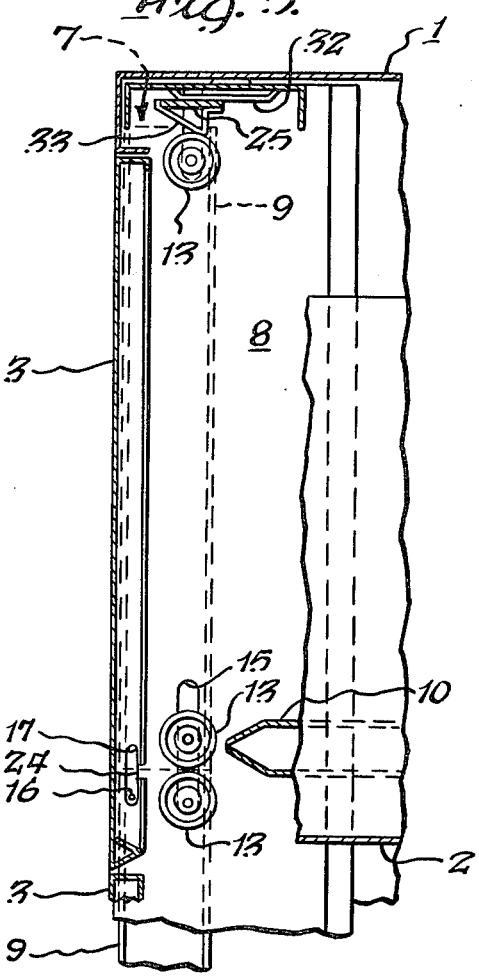
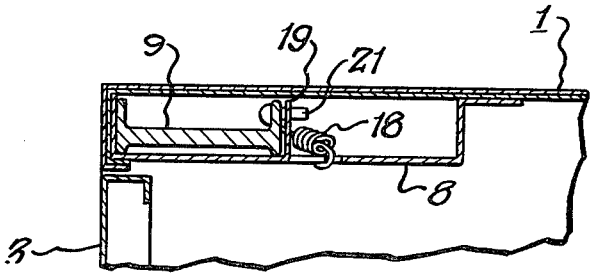
Fig. 6.

CABINET DRAWER ANTI-TIP LOCK DEVICE

TECHNICAL FIELD OF THE INVENTION

The present invention relates to file cabinets and locking means for preventing cabinet drawer openings. More specifically, the invention relates to a locking means and anti-tip mechanism for lateral files having vertically arranged roll-out drawers or shelves and horizontally pivoted doors therefor.

BACKGROUND OF THE INVENTION

It has long been a primary objective of those working in the filing cabinet and business office furniture art to provide means whereby a filing cabinet may not only be locked against unauthorized entry but also to provide an anti-tip mechanism which secures the doors and/or drawers of the cabinet against the sequential opening of more than one drawer at any one particular time. It has also been a further and long time objective of those versed in the art to find a means whereby the foregoing objective could be accomplished in economical fashion. That these objectives have not been satisfactorily achieved is evidenced by the multitude of inventions proposed to this end, representative of which are those disclosed in the following U.S. Pat. Nos. 3,900,236 issued Aug. 19, 1975; 3,199,937 issued Aug. 10, 1965; 3,888,558 issued June 10, 1975; 3,404,929 issued Oct. 8, 1968; 3,883,220 issued May 13, 1975; 3,602,564 issued Aug. 31, 1971; and 3,297,376 issued Jan. 10, 1967. These patents may be relevant to the invention claimed herein in that they relate to filing cabinets having anti-tip structure.

Filing cabinets heretofore proposed, such as those patents listed above, have suffered from a variety of deficiencies and difficulties. While the prior art anti-tip mechanisms have been generally successful in preventing more than one drawer from being opened at a time when the drawers are opened only one at a time, most such anti-tip mechanisms have been ineffective in preventing more than one drawer from being opened simultaneously. Thus, U.S. Pat. Nos. 3,888,558, 3,883,200 and 3,404,929 are examples of cabinets which do not prevent the simultaneous opening of more than one drawer and U.S. Pat. No. 3,602,564 is exemplary of a cabinet which includes a door interlock which does not prevent more than one door from being opened simultaneously. This deficiency in the prior art designs may lead to the upsetting of the entire cabinet when the cabinet itself is tipped slightly so that the drawers tend to run open of their own weight at the same time: a not uncommon circumstance when the cabinet is being moved. The solution to this problem proposed by U.S. Pat. Nos. 3,900,236 and 3,199,937 involves significant complication of the design of the anti-tip mechanism, which complications lead to excessive costs and difficulties in assembly of the cabinets.

An additional problem which has been encountered when prior anti-tip devices have been incorporated in filing cabinets is that such mechanisms frequently add additional depth to the cabinet and/or do not permit the drawer of the cabinet to be opened to a degree that the contents of the drawer can be removed vertically from the opened drawer. This difficulty is magnified when the cabinet is of the lateral file type in which cabinet depth is of primary importance and in which vertical deposit and removal of the filing material is a requirement. In an attempt to address this requirement, U.S. Pat. No. 3,900,236 has proposed a device having a complicated camming keeper mechanism which is subject to failure in the event that debris or rust were to interfere with the motion of the cam wheel and is both expensive and difficult to fabricate. Furthermore, since the keeper mechanism is actuated upon opening and removal of one drawer from the cabinet, and is not deactivated until the drawer is returned to its closed position, all of the remaining drawers are prevented from complete removal from the cabinet in the event that it is desirable to lighten the cabinet to facilitate its transport by the complete removal of all of the drawers. Accordingly, the file cabinet disclosed by U.S. Pat. No. 3,900,236 can be lightened by the complete removal of only one drawer at any one time, which capability may not be of any significant help when the cabinet is transported. Further lightening of the cabinet requires the inconvenient expedient of removing the contents of the other drawers rather than complete removal of the drawers themselves.

The foregoing, as well as other problems encountered by prior art devices have been generally overcome by my prior U.S. Pat. No. 4,272,138 issued on June 9, 1981. In this patent the anti-tip mechanism includes a segmented column consisting of a plurality of longitudinally extending locking bars or snubber elements axially aligned in ent-to-end abutting relation. The columns extend adjacent to each one of a plurality of horizontally movable components such as roll-out shelves, drawers and/or other suitable storage units together with an equal number of doors movable from a closed, blocking position to an open, releasing position. The columns are each resiliently mounted within the cabinet by a plurality of leaf-type springs which function to bias the columns to a central equilibrium position and to permit movement thereof to one of two axially displaced positions. Each drawer carries on its side an activator rail which is disposed at right angles to the column. The tapered end of each activator rail is positioned so as to insinuate itself between two adjacent abutting snubber elements when the respective component is opened. The act of activator rail insulation between adjacent snubber elements causes each of the snubber elements in the column to be displaced from a central equilibrium position to one of two displaced positions. In their displaced positions, the snubber elements block subsequent opening of any second component.

Additionally, the cabinet of my aforesaid patent includes a lock means for simultaneously locking the doors and the components against movement from their closed to their open positions when in a locking mode and for permitting movement of a single drawer from its closed to its open position while simultaneously locking both the remaining unopened doors and all of the other drawers against movement from their closed to their open position when in an unlocking mode. Such lock means includes a reciprocating key operated plunger lock, a linkage in the form of an angle iron and a pin laterally extending from the uppermost column. The angle iron is disposed horizontally within the cabinet, is pivotally mounted on the end of the plunger lock and is positioned adjacent the laterally extending pin whereby depression of the plunger lock causes the angle iron to pivot into engagement with the pin to cause the segmented locking bars to be driven downwardly into a locking position.

SUMMARY OF THE INVENTION

The present invention relates to certain modifications of the structural components disclosed and described in my prior U.S. Pat. No. 4,272,138.

More specifically, in accordance with the teachings of the present invention the segmented locking bar columns are provided with but a single resilient means for biasing the same into their equilibrium position in readiness for one of the horizontally moveable components to be moved into its open, laterally extended position. This resilient means causes abutting and positive engagement between a pin and tab located on one or the other of the snubber elements and the cabinet frame whereby the snubber elements are automatically and positively urged to their equilibrium positions, regardless of variations in the spring constant of said resilient means.

It is a further feature of the present invention to provide a lock means for simultaneously locking the doors and the horizontally moving components against movement from their closed to their open position when in a locking mode and for permitting movement of a single component from its closed to its open position while simultaneously locking both the remaining unopened doors and all the other components against movement from their closed to their open positions when in an unlocking mode. Such lock means includes at least one laterally extending member pivotally mounted between the ends thereof to the cabinet housing, one end of which member being provided with a downwardly and inwardly sloped camming surface adjacent an interior sidewall of the cabinet for coaction with the uppermost segmented locking bar column to move the columns into their locked positions. The other end of the laterally extending member being pivotally connected to a reciprocable plunger lock; the plunger of which being resiliently biased to its open position whereby the cammed end of the laterally extending member is, in turn, biased into its position of disengagement with the uppermost segmented locking bar column.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which:

FIG. 1 is a perspective view of a typical lateral file having horizontally pivoted doors and horizontally movable drawers;

FIG. 2 is a cross-section view of the locking linkage of the cabinet of FIG. 1 taken along view line 2—2;

FIG. 3 is a partial cross-section view taken along view lines 3—3 of FIG. 2;

FIG. 4 is a partial cross-section side elevation of the anti-tip mechanism of the invention in unlocked unsnubbed attitude taken along view lines 4—4 of FIG. 1;

FIG. 5 is an illustration similar to that shown in FIG. 4 but showing the cabinet in a drawer and door locking mode;

FIG. 6 is a partial cross-section view taken along view lines 6—6 of FIG. 4;

DESCRIPTION OF THE PREFERRED EMBODIMENTS

Figure 8:
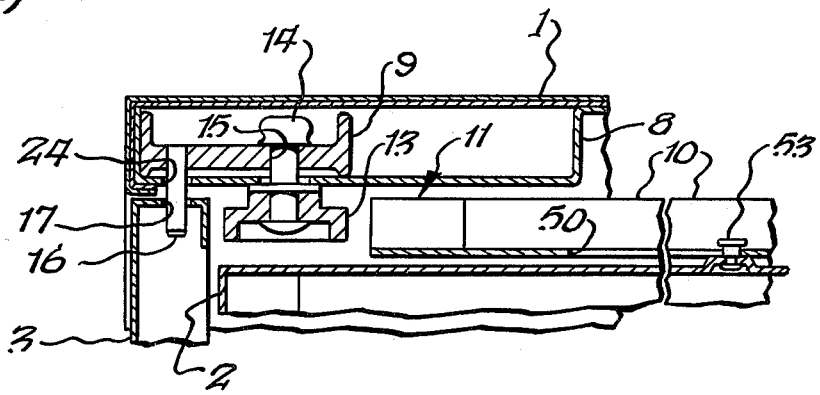
FIG. 8 is a cross-section of the mechanism illustrated in FIG. 4 taken along the view lines 8—8.

While the invention is susceptible of various modifications and alternative constructions, there is shown in the drawings and there will hereinafter be described, in detail, a description of the preferred or best known mode of the invention. It is to be understood, however, that the specific description and drawings are not intended to limit the invention to the specific form disclosed. On the contrary, it is intended that the scope of this patent include all modifications and alternative constructions thereof falling within the spirit and scope of the invention as expressed in the appended claims to the full range of their equivalents.

FIG. 1 generally illustrates a cabinet which consists of a cabinet housing 1, a plurality of vertically arranged horizontally movable components 2 and an equal plurality of doors 3 which may be closed over the components when in their retracted positions. In the context of a lateral file, the movable components may be roll-out shelves or drawers or other similar storage units: the term drawer being used hereafter for the sake of simplicity. A reciprocating key operated plunger lock 4 is provided to lock and unlock both the doors and drawers.

Operation of the locking mechanism of the cabinet may be better seen in FIGS. 2–5 which show one possible linkage 5 between the plunger lock 4, and a pair of locking bars 6 and 7 vertically disposed at opposite lateral sides of the cabinet housing 1. The illustrated locking linkage 5 comprises a pair of laterally extending members in the form of flat or planar lock links 25,27 which are centrally pivotally mounted at 29,31 to a top cross frame 32 of housing 1. The outer ends of each lock link 25,27 are provided with downwardly and inwardly extending sloped camming surfaces 33, only one of which is illustrated in FIGS. 4 and 5. The inner ends of each lock link 25,27 are pivotally mounted at 35,37 to a cross bar 39 which is suitably affixed to the interior end of plunger lock 4. A compression spring 41 is interposed between cross bar 39 and a laterally extending cross-frame 43 of housing 1 which functions to normally bias the lock linkages 25 and 27 clockwise and counterclockwise, respectively, about their pivots 29 and 31 and to bias plunger 4 to its open or unlocked position of maximum extension from cabinet housing 1. As will become apparent hereinbelow, camming surfaces 33 are positioned for coaction with locking bars 6 and 7 so that depression of plunger lock 4 causes locking bars 6 and 7 to be driven downwardly to a "locking" position (FIGS. 5 and 7) in response to movement of lock links 25,27 about their respective pivots 29,31. This movement of the lock links can be seen from the solid line to the dashed line position thereof in FIG. 2.

In a preferred embodiment, locking bars 6 and 7 are mounted within a vertically extending channel 8, which is part of the cabinet, in a manner which permits the vertically extending lock bars 6 or 7 to be vertically or axially displaced yet horizontally restrained. One manner of accomplishing this is to provide vertically extending slots within channels 8 through which members fixed to bars 6 or 7 project. Members 14 and 16 and respective slots 15 and 24 as illustrated in FIG. 8 are exemplary of this structure.

Turning now to a closer examination of FIGS. 4, 5,6,7 and 8, the anti-tip mechanism of the present invention will be described. Located at one side of the cabinet, locking bar 7 comprises a segmented column consisting of a plurality of longitudinally extending snubber elements 9 axially aligned in end-to-end abutment. The abutting ends of each snubber element 9 are preferably equipped with a roller 13 mounted on an axle 14 which is fixed to its snubber element 9. The entire column or locking bar 7 is resiliently biased to positively assume a central equilibrium, such that the bar and its elements may be displaced to either of two oppositely axially displaced positions. To this end, a suitable tension spring 18 may be hooked between the edge of the lowermost snubber element 9 and to a side wall of housing channel 8 to thereby normally bias lowermost snubber element 9 and those thereabove to an upward equilibrium position. A tab 19 is suitably drawn out of channel 8 adjacent lowermost element 9 in alignment with and for coaction with a pin or stud 21 fixed thereto to thereby limit upward movement of the snubber elements and to provide an abutment against canting or horizontal movement thereof (FIGS. 4 and 6). In this manner, the equilibrium position is positively set by abutment action between tab 19 and stud 21, without reliance upon maintaining a uniform or nonvarying spring constant for spring 18. All that is required is a minimum spring force sufficient to urge all snubber elements in a position whereat stud 21 engages tab 19.

Figure 7:
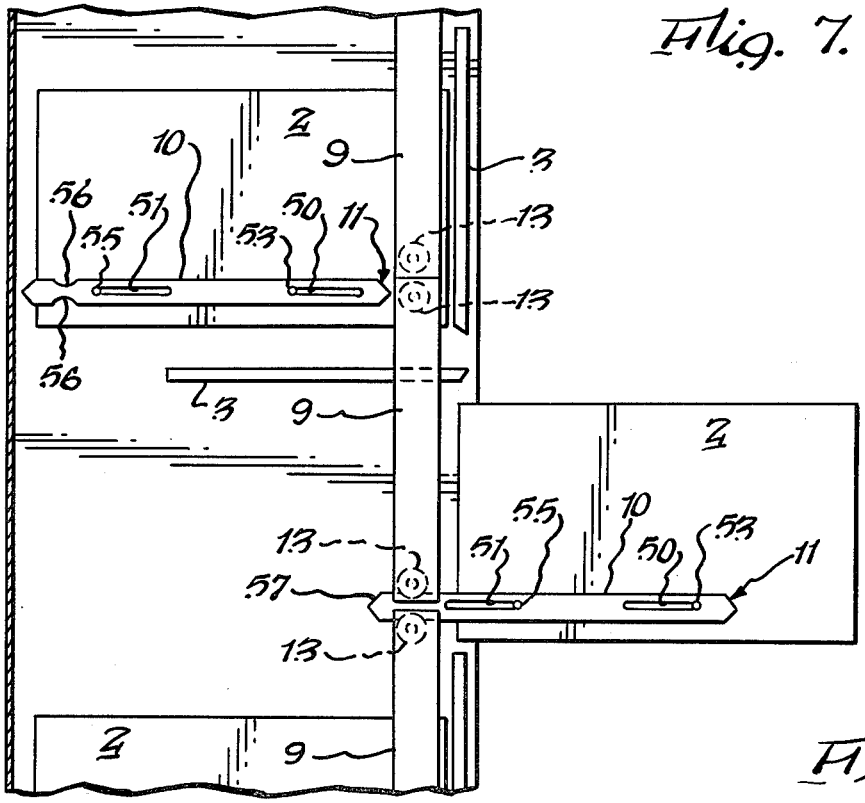
FIG. 7 is a simplified side elevation showing one drawer extended so as to illustrate the functioning of the anti-tip mechanism of the invention.

Each drawer of the cabinet is outfitted with an activator rail 10 which is carried on the side of the drawer in a position, when the drawer is closed, adjacent to the point of abutment of two adjacent snubber elements 9. The leading end 11 of activator rail 10 is preferably pointed or tapered to have two oppositely inclined camming surfaces 12 so that movement of the drawer in an outwardly direction causes the leading end and eventually the entire activator rail 10 to be insinuated between the adjacent roller 13 of adjacent snubber elements. It will be understood that this such insertion causes the snubber elements above the drawer to be displaced axially upwardly while the snubber elements below the drawer are simultaneously displaced axially downwardly. FIG. 7 illustrates just such a displaced condition. As can be seen, displacement of the snubber elements in the column causes a roller 13 to be moved to a position which blocks subsequent outward movement of each of the activator elements of each of the remaining unopened drawers. In this manner, the action of opening one drawer effectively precludes subsequent opening of any other drawer of the cabinet.

Furthermore, it can be seen from an examination of the figures that simultaneous opening of more than one drawer is also effectively prevented since simultaneous opening of at least two drawers would require the physical compression or distortion of the snubber elements or elements 9 intermediate the activator rails 10 of the two drawers being simultaneously opened. Since snubber elements 9 are constructed of rigid structural material and rollers 13 are fixedly positioned on the ends of their respective snubber elements, compression or distortion of the intermediate snubber elements is an impossibility under loads normally expected to be encountered during normal operation of the filing cabinet.

An additional feature of the invention which prevents simultaneous opening of two or more drawers of the filing cabinet can be found in the manner in which the snubber elements are mounted for axial reciprocation within structural channel 8 of the filing cabinet. Each snubber element 9 lies within the channel 8 while rollers 13 lie on the exterior of the channel. Axle members 14 as best seen in FIG. 8 extend through axially extending slots 15 formed in the side of structural channel 8. Slots 15 are dimensioned to be substantially equal to the sum of the diameter of roller 13, the diameter of the axle 14, and the vertical thickness of an activator rail 10. This being the case, each roller 13 and each snubber element 9 is permitted an axial deflection in either direction which is limited to one half of the vertical thickness of the activator rails 10 by the axial limits of the slots 15 formed in channel 8 with the effect that each of the snubber elements is locked in its axially displaced position when one of the doors has been opened.

As can be seen best in FIG. 7 the preferred embodiment of activator rail 10 is a "floating rail" and includes a pair of longitudinally extending slots 50 and 51 through which project a pair of mounting shanks or studs 53 and 55. Depressions 56 are formed at the innermost end of activator rail 10 and cooperate with rollers 13 when the drawer has been pulled out to an extended position. It may further be desirable, as shown at the trailing end of activator rail 57 to taper the rail so as to facilitate insertion of the rail 10 in between adjacent rollers 13 when the drawer is originally inserted into the cabinet.

The just described structure function in a manner which permits the drawer to be moved to a position external to the cabinet 1 while being supported thereby so that the full filing depth of the drawer 2 can be used when the stored materials are to be drop filed. This feature minimizes the necessary depth of the cabinet. Upon first outward movement of drawer 2, leading end 11 of activator rail 10 insinuates itself between adjacent rollers 13 thereby causing displacement of the snubber elements 9 in the column. Outward movement of the drawer 2 causes stud or shank 53 in slot 50 to move outwardly beyond rollers 13. This action releases the "floating" activator rail 10 so that the friction between rail 10 and wheels 13 causes the activator rail 10 to lag behind the drawer 2 as it moves to its extended position. Depressions 56 assist further in this action as rollers 13 encounter the depression. As a result, as can be seen from FIG. 7, when drawer 2 is fully extended to its full open position, activator rail 10 is caused to extend out from the back of the drawer in a manner which maintains the anti-tip device in its activated condition.

Figure 9:
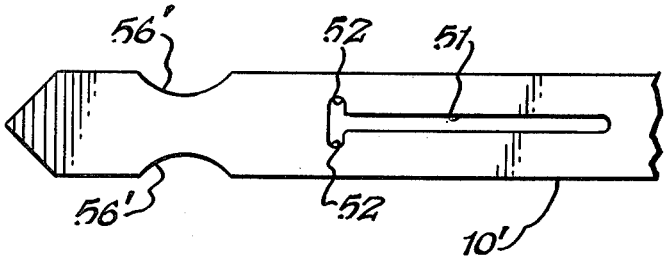
FIG. 9 is a fragmentary side elevational view illustrating a slight modification to the activator rail configuration.

Although slot 51 has been illustrated and described as substantially straight, it should be understood that the same could be provided with means to prevent the "floating" type action of activator rail 10 upon first movement of the drawer from its fully inserted position. Such means may take the form of a single upwardly directed dog-leg at the innermost end of slot 15 as clearly described and illustrated in my prior U.S. Pat. No. 4,272,138. Of course, the dog-legs also function to reduce the "free travel" of the drawers in snubbed or unsnubbed, locked or unlocked attitudes. Alternatively, such slot 51 may be provided with upwardly directed and downwardly directed dog-legs 52 as illustrated in FIG. 9. In this manner, the rail 10' may be interchangeably applied to both sides of the drawers without any modifications in the fabrication thereof.

A further feature of the present invention is the ability of the locking/anti-tip mechanism to simultaneously lock all unopened doors in their closed position when one of the drawers is moved to its open position. This feature results from the co-action between laterally projecting locking pins 16, carried by snubber element 9, and a C-shaped opening 17 formed in a side flange of each of the doors 3 of cabinet 1. When snubber elements 9 are in their central equilibrium positions, the opening of C-shaped slots 17 on each of the drawers is such that each door may be horizontally pivoted around its upper horizontal hinge from a closed to an opened position with pin 16 moving freely through the centrally located exit opening of the slot 17. Deflection of locking pins 16 in either direction resulting from deflection of the snubber elements 9 produced by the opening of one of the drawers 2, causes pins 16 to be moved to an axially displaced position in slot 17 which prevents subsequent outward movement of respective closed door 3. Accordingly, not only are all unopened drawers prevented from subsequent opening by the locking anti-tip mechanism of the present invention, but also each previously unopened door 3 is prevented from subsequent opening.

The above described structure is also useful as a means for permanently locking both drawers and doors in their closed positions when plunger lock 4 is depressed to assume its locking mode. Such depression causes the cammed surface 33 at the outer ends of locking links 25 and 27 to engage the rollers 13 of the uppermost snubber elements 9 to thereby cause vertical downward displacement of all of the snubber elements 9 in the segmented column 7 so that both the door locking pins 16 and the drawer locking rollers 13 are moved to their respective locking positions. Since the construction of many such filing cabinets is such that doors 3 are made out of relatively broad sheets of sheet metal, it is desirable to cause both sides of the door 3 to be locked at the same time as opposed to providing locking of only one side. Accordingly, locking bar 6, which may either be a segmented column having snubber elements as already described, or a solid vertically extending bar, having an upper roller 13, is also provided with locking pins 16 which are received within C-shaped slots 17 formed on the opposite ends of doors 3. In this manner, actuation of lock plunger 4 and the concomitant operation of linkage 5 causes roller 13 on the upper end of locking bar 6 to be axially deflected downwardly to cause corresponding locking pins 16 to be moved into a position which engages the opposite sides of the doors 3 so that each door is locked from both of its opposite sides.

Although the drawers 2 have been depicted as "open-front" file type units with separate door closure units 3, it is contemplated that any type of drawer, such as one having a closure unit or "fixed front" rigidly affixed thereto, may be employed without departing from the teachings of the present invention.

What is claimed is:

1. An improved cabinet of the type having a case with a plurality of horizontally movable components mounted therein, the improvement characterized by an anti-tip mechanism for preventing more than one component from being opened to its fully extended position at one time, said anti-tip mechanism comprising:

a segmented lock bar extending adjacent each of said components, said lock bar comprising a plurality of longitudinally extending snubber elements axially aligned in end-to-end abutment;

a single abutment element on only one of said snubber elements and a single abutment element on said case in vertical alignment with said first mentioned abutment element;

a single resilient means for urging said abutment elements into engagement to limit vertical movement of said one snubber element whereby all of said snubber elements are maintained in a central equilibrium position and are movable therefrom in opposite directions to first and second opposite axially displaced positions;

a plurality of longitudinally extending activator rails each disposed substantially normal to said lock bar, each rail being carried by a different one of said components, each rail being disposed with one of its ends positioned to insinuate itself between adjacent snubber elements when its respective component is opened and so shaped with respect to said adjacent snubber elements to displace all of the snubber elements from their central equilibrium positions to one of said first and second positions with the snubber elements located in one of said directions with respect to said insinuated rail moving to said first axially displaced position and those located in the opposite of said one direction moving to said second axially displaced position, whereby the remainder of said plurality of rails and their respective components are blocked by a displaced snubber element.

2. The improved cabinet as recited in claim 1 characterized in that one of said abutment elements is located on the lowermost of said snubber elements.

3. The improved cabinet as recited in claim 2 characterized in that said abutment element on the lowermost of said snubber elements comprises a pin projecting therefrom and said other abutment element comprises a tab projecting from said cabinet case in vertical alignment with said pin.

4. The improved cabinet as recited in claim 3 characterized in that said resilient means comprises a coiled tension spring fixed between a lower edge of said lowermost snubber element and said case to thereby urge said lowermost snubber element in an upward direction causing said pin and tab to engage to limit the upward travel of said lowermost snubber element.

5. The improved cabinet as recited in claim 1 characterized in that each rail has a pointed leading end formed of a pair of oppositely facing leading surfaces each inclined to both the longitudinal axis of said lock bar and the longitudinal axis of said rail.

6. The improved cabinet as recited in claim 5 characterized in that said snubber elements include rollers at their abutting ends thereby facilitating the insinuation of said pointed end of the respective rail therebetween and subsequent movement of said respective rail between adjacent snubber elements.

7. The improved cabinet as recited in claim 6 characterized in the provision of lock means for simultaneously locking said components against movement from their closed to their open position, said lock means includes at least one laterally extending rigid lock link pivotally mounted to said case for arcuate movement with respect thereto, one end of said lock link located adjacent the roller of said uppermost snubber element and having a cammed surface rigidly fixed thereto, said cammed surface actuable to engage said roller to force said snubber elements downward from said equilibrium position; and said lock means further includes a lock plunger assembly to which the other end of said rigid lock link is pivotally connected and mounted for linear movement substantially transverse of said snubber elements and resilient means for biasing said lock plunger to normally urge said cammed surface to its position of disengagement with the roller of said uppermost snubber element, whereby linear movement of said lock plunger against the bias of said resilient means causes pivotal movement of said rigid lock link and said cammed surface is forced into contact with said roller to force said snubber elements downward from said equilibrium position.

8. The improved cabinet as recited in claim 1 characterized in the provision of lock means for simultaneously locking said components from their closed to their open position, said lock means includes at least one laterally extending lock link pivotally mounted to said case, one end of said lock link located adjacent said uppermost snubber element and having a cammed surface thereat actuable to engage said uppermost snubber element to force said snubber elements downward from said equilibrium position.

9. The improved cabinet as recited in claim 8 characterized in that said lock means further includes a lock plunger assembly to which the other end of said lock link is pivotally connected and resilient means for biasing said lock plunger to normally urge said cammed surface to its position of disengagement with the uppermost snubber element.

10. The improved cabinet as recited in claim 1 characterized in that each activator rail is mounted on the side of a different one of said components by means for permitting said rail to extend in back of its respective component when fully extended, whereby the component is permitted to be extended to its fully extended position without causing said rail to be withdrawn from between the displaced adjacent snubber elements.

11. The improved cabinet as recited in claim 10 characterized in that said rail mounting means includes a pair of horizontally extending slots formed in the side of said rail, and a pair of rail supporting shanks mounted on the side of the component, each shank extending into one of said slots.

12. The improvement according to claim 11 wherein one of said slots includes upwardly and downwardly directed dog-legs at one end thereof, one of which being adapted to receive one of said shanks.

13. The improved cabinet as recited in claim 1 further characterized by including a door for each component, said door being movable from a closed, component blocking position, to an open component releasing position, said segmented lock bar including means for engaging and locking each closed door when one component of said cabinet is moved to its extended position.

14. An improved cabinet of the type having a cabinet housing with a plurality of horizontally movable components mounted therein and an equal plurality of doors movable from a closed, component blocking position to an open, component releasing position, the improvement characterized by including:

lock means for simultaneously locking said doors and said components against movement from their closed to their open position when in a locking mode and for permitting movement of a single component from its closed to its open position while simultaneously locking both the remaining unopened doors and all of the other components against movement from their closed to their open positions when in an unlocking mode, said lock means includes vertically disposed lock bars at each side of said cabinet for locking said doors, at least one of said lock bars comprising a segmented column locking bar, the segments of which are displaced in opposite directions by an opened component to thereby block the other unopened components above and below said opened components from movement towards an opening position;

a single abutment element on only one of said segments and a single abutment element on said housing in vertical alignment with said first mentioned abutment element; and a single resilient means for urging said abutment elements into engagement to limit upward displacement of said one segment to a position whereat any one of said components may be moved from its closed to its open position.

15. The improved cabinet as recited in claim 14 characterized in that said cabinet is of the lateral file cabinet type having vertically arranged storage units and doors, each of said doors being hung for pivotal movement about a horizontal axis, and characterized in that said lock means includes means for concurrently locking both sides of each door when in its locking mode.

16. The improved lateral file cabinet as recited in claim 15 characterized in that said segmented column comprises a plurality of longitudinally extending snubber elements axially aligned in end-to-end abutting relationship, each of said snubber elements being axially movable from a central rest position to each one of two opposite axially displaced positions, each of said plurality of movable storage units having mounted thereon a longitudinally extending activator rail, each rail being disposed with an end position to insinuate itself between two adjacent snubber elements as its respective storage unit is moved from its closed to its open position while causing each of said two adjacent snubber elements to be displaced in opposite direction from its central rest position to an opposite one of its axially displaced positions, whereby displacement of said two adjacent snubber elements cause all remaining snubber elements to be similarly displaced so that all remaining storage units and their respective activator rails are blocked against subsequent movement from their closed to their open position.

17. The improved lateral file cabinet as recited in claim 16 characterized in that said lock means includes a plunger lock, a first laterally extending lock linkage pivotally mounted to said housing and having means at one end for engaging the uppermost snubber element and connected at the other end to said plunger lock and a second laterally extending lock linkage pivotally mounted to said housing and having means at one end for engaging said vertically disposed locking bar and connected at its other end to said plunger lock whereby movement of said plunger lock from its open position to its locked position causes simultaneous pivotal movement of said first and second laterally extending lock linkages whereby the means at said one end thereof engages their respective snubber element and locking bar to force the same downwardly to their locked positions.

18. An improved cabinet of the type having a case with a plurality of horizontally movable components mounted therein, the improvement characterized by an anti-tip mechanism for preventing more than one component from being opened to its fully extended position at one time, said anti-tip mechanism comprising:

a segmented lock bar extending adjacent each of said components, said lock bar comprising a plurality of longitudinally extending snubber elements axially aligned in end-to-end abutment;

a plurality of longitudinally extending activator rails each disposed substantially normal to said lock bar, each rail being carried by a different one of said components, each rail being disposed with one of its ends positioned to insinuate itself between adjacent snubber elements when its respective component is opened and so shaped with respect to said adjacent snubber elements to displace all of the snubber elements from a central equilibrium position to one of two opposite axially displaced positions with the snubber elements located above said insinuated rail moving to one of said axially displaced positions and those located below said insinuated rail moving to the other of said axially displaced positions, whereby the remainder of said plurality of rails and their respective components are blocked by a displaced snubber element; and lock means for simultaneously locking said components against movement from their closed to their open position, said lock means includes at least one laterally extending rigid lock link pivotally mounted to said case for arcuate movement with respect thereto, one end of said lock link located adjacent the roller of said uppermost snubber element and having a cammed surface rigidly fixed thereto, said cammed surface actuable to engage said roller to force said snubber elements downward from said equilibrium position; and said lock means further includes a lock plunger assembly to which the other end of said rigid lock link is pivotally connected and mounted for linear movement substantially transverse of said snubber elements and resilient means for biasing said lock plunger to normally urge said cammed surface to its position of disengagement with the roller of said uppermost snubber element, whereby linear movement of said lock plunger against the bias of said resilient means causes pivotal movement of said rigid lock link and said cammed surface is forced into contact with said roller to force said snubber elements downward from said equilibrium position.

* * * * *